US008643559B2

(12) United States Patent
Deng et al.

(10) Patent No.: US 8,643,559 B2
(45) **Date of Patent: *Feb. 4, 2014**

(54) TRIPLE STAGGER OFFSETABLE AZIMUTH BEAM WIDTH CONTROLLED ANTENNA FOR WIRELESS NETWORK

(75) Inventors: Gang Yi Deng, Irvine, CA (US); Alexander Rabinovich, Cypress, CA (US); Nando Hunt, Newport Beach, CA (US); John J. Dickson, Cypress, CA (US); John Stewart Wilson, Huntington Beach, CA (US)

(73) Assignee: P-Wave Holdings, LLC, Los Angeles, CA (US)

( * ) Notice: Subject to any disclaimer, the term of this patent is extended or adjusted under 35 U.S.C. 154(b) by 765 days.

This patent is subject to a terminal disclaimer.

(21) Appl. No.: 12/157,646

(22) Filed: Jun. 11, 2008

(65) Prior Publication Data

US 2008/0309568 A1 Dec. 18, 2008

Related U.S. Application Data

(60) Provisional application No. 60/934,371, filed on Jun. 13, 2007.

(51) Int. Cl.
*H01Q 3/18* (2006.01)
*H01Q 21/08* (2006.01)

(52) U.S. Cl.
USPC ..... 343/758; 343/761; 343/839; 343/879; 343/880

(58) Field of Classification Search
USPC ..... 343/754, 795–800, 824, 853, 761, 839, 343/844, 757, 758, 879, 880
See application file for complete search history.

(56) References Cited

U.S. PATENT DOCUMENTS

| | | | | | |
|---|---|---|---|---|---|
| 2,473,421 | A | * | 6/1949 | Fubini et al. | 343/761 |
| 2,535,049 | A | * | 12/1950 | De Rosa | 343/880 |
| 5,274,391 | A | | 12/1993 | Connolly | |
| 5,345,248 | A | | 9/1994 | Hwang et al. | |
| 5,572,222 | A | | 11/1996 | Mailandt et al. | |
| 5,949,303 | A | | 9/1999 | Arvidsson et al. | |
| 5,966,102 | A | | 10/1999 | Runyon | |
| 5,969,689 | A | | 10/1999 | Martek et al. | |

(Continued)

FOREIGN PATENT DOCUMENTS

| | | |
|---|---|---|
| EP | 0566522 | 10/1993 |
| EP | 1098391 | 5/2001 |
| EP | 1950832 | 7/2008 |
| WO | 2005/060045 | 6/2005 |

OTHER PUBLICATIONS

International Search Authority, Written Opinion for International Application No. PCT/US08/07333 mailed Aug. 8, 2008.

(Continued)

*Primary Examiner* — Michael C Wimer
(74) *Attorney, Agent, or Firm* — Verrill Dana, LLP; Chris A. Caseiro

(57) ABSTRACT

A variably controlled stagger antenna array architecture is disclosed. The array employs a plurality of driven radiating elements that are spatially arranged having each radiating element or element groups orthogonally movable relative to a main vertical axis. This provides a controlled variation of the antenna array's azimuth radiation pattern without excessive side lobe radiation over full range of settings.

6 Claims, 12 Drawing Sheets

(56) References Cited

U.S. PATENT DOCUMENTS

| | | | |
|---|---|---|---|
| 6,034,649 | A | 3/2000 | Wilson et al. |
| 6,285,336 | B1 | 9/2001 | Zimmerman |
| 6,515,633 | B2 | 2/2003 | Ippolito |
| 6,529,172 | B2 | 3/2003 | Zimmerman |
| 6,567,055 | B1 | 5/2003 | Oglesby |
| 6,697,029 | B2 | 2/2004 | Teillet et al. |
| 6,717,555 | B2 | 4/2004 | Teillet et al. |
| 6,747,606 | B2 | 6/2004 | Harel et al. |
| 6,756,939 | B2 | 6/2004 | Chen et al. |
| 6,809,694 | B2 | 10/2004 | Webb et al. |
| 6,822,618 | B2 | 11/2004 | Bisiules et al. |
| 6,864,837 | B2 | 3/2005 | Runyon et al. |
| 6,922,169 | B2 | 7/2005 | Izzat et al. |
| 6,924,776 | B2 | 8/2005 | Le et al. |
| 6,933,905 | B2 | 8/2005 | Ippolito |
| 6,950,061 | B2 | 9/2005 | Howell et al. |
| 7,006,053 | B2 | 2/2006 | Zigler et al. |
| 7,075,497 | B2 | 7/2006 | Teillet et al. |
| 7,173,572 | B2 | 2/2007 | Teillet et al. |
| 7,183,989 | B2 | 2/2007 | Tietjen |
| 7,358,922 | B2 | 4/2008 | Le et al. |
| 7,405,710 | B2 | 7/2008 | Bisiules et al. |
| 7,710,344 | B2 | 5/2010 | Deng et al. |
| 2002/0135528 | A1 | 9/2002 | Teillet et al. |
| 2002/0149529 | A1 | 10/2002 | Fleming et al. |
| 2004/0051677 | A1 | 3/2004 | Göttl |
| 2005/0192727 | A1 | 9/2005 | Shostak et al. |
| 2005/0219140 | A1 | 10/2005 | Browne et al. |
| 2005/0231437 | A1 | 10/2005 | Dai et al. |
| 2007/0008236 | A1 | 1/2007 | Tillery et al. |
| 2007/0030208 | A1 | 2/2007 | Linehan |
| 2007/0146222 | A1 | 6/2007 | Mansour |
| 2007/0205952 | A1 | 9/2007 | Deng et al. |
| 2007/0241979 | A1 | 10/2007 | Yang |
| 2009/0015498 | A1 | 1/2009 | Deng et al. |
| 2009/0262039 | A1 | 10/2009 | Lytle et al. |

OTHER PUBLICATIONS

International Search Authority, Written Opinion for International Application No. PCT/US 08/03176 dated Jun. 11, 2008, 8 pages.
International Search Authority, Written Opinion for International Application No. PCT/US 08/02845 dated Jun. 2, 2008, 7 pages.
Supplemental European Search Report pertaining to European Patent Application No. 07751869.4/PCT/2007005137 mailed Feb. 4, 2010.
Office Action dated Dec. 6, 2010 from U.S. Appl. No. 12/080,483.
Office Action dated Nov. 18, 2011 from U.S. Appl. No. 12/080,483, 7 pages.

* cited by examiner

A'-A'

A-A

B'-B'

B-B

A-A

A'-A'

TRIPLE STAGGER OFFSETABLE AZIMUTH BEAM WIDTH CONTROLLED ANTENNA FOR WIRELESS NETWORK

RELATED APPLICATION INFORMATION

The present application claims priority under 35 USC section 119(e) to U.S. provisional patent application Ser. No. 60/934,371 filed Jun. 13, 2007, the disclosure of which is incorporated herein by reference in its entirety.

BACKGROUND OF THE INVENTION

1. Field of the Invention

The present invention relates in general to communication systems and components. More particularly the present invention is directed to antenna arrays for cellular communications systems.

2. Description of the Prior Art and Related Background Information

Modern wireless antenna implementations generally include a plurality of radiating elements that may be arranged over a reflector plane defining a radiated (and received) signal beam width and azimuth scan angle. Azimuth antenna beam width can be advantageously modified by varying amplitude and phase of an RF signal applied to respective radiating elements. Azimuth antenna beam width has been conventionally defined by Half Power Beam Width (HPBW) of the azimuth beam relative to a bore sight of such antenna array. In such an antenna array structure radiating element positioning is critical to the overall beam width control as such antenna systems rely on accuracy of amplitude and phase angle of the RF signal supplied to each radiating element. This places severe constraints on the tolerance and accuracy of a mechanical phase shifter to provide the required signal division between various radiating elements over various azimuth beam width settings.

Real world applications often call for an antenna array with beam down tilt and azimuth beam width control that may incorporate a plurality of mechanical phase shifters to achieve such functionality. Such highly functional antenna arrays are typically retrofitted in place of simpler, lighter and less functional antenna arrays while weight and wind loading of the newly installed antenna array can not be significantly increased. Accuracy of a mechanical phase shifter generally depends on its construction materials. Generally, highly accurate mechanical phase shifter implementations require substantial amounts of relatively expensive dielectric materials and rigid mechanical support. Such construction techniques result in additional size and weight not to mention being relatively expensive. Additionally, mechanical phase shifter configurations that have been developed utilizing lower cost materials may fail to provide adequate passive intermodulation suppression under high power RF signal levels.

Consequently, there is a need to provide a simpler method to adjust antenna beam width control.

SUMMARY OF THE INVENTION

In a first aspect the present invention provides an antenna for a wireless network comprising a generally planar reflector, a plurality of radiators, and one or more actuators coupled to at least some of the radiators. The radiators are reconfigurable from a first configuration where the radiators are all aligned to a second configuration where the radiators are configured in three columns, each column having plural radiators generally aligned.

In a preferred embodiment of the antenna the plurality of radiators comprise a first and second plurality of radiators which are movable and a third plurality of radiators which are fixed. The first and second plurality of radiators are preferably movable in opposite directions. In a preferred embodiment a first plurality of radiator mount plates are coupled to the first plurality of radiators and slidable relative to the reflector and a second plurality of radiator mount plates are coupled to the second plurality of radiators and slidable relative to the reflector. The reflector preferably has a plurality of orifices and the first and second plurality of radiator mount plates are configured behind the orifices. The reflector is preferably generally planar and is defined by a Y-axis and a Z-axis parallel to the plane of the reflector and an X-axis extending out of the plane of the reflector, and the radiators are spaced apart a distance VS in the Z direction. The reflectors in the first configuration are preferably aligned along a center line parallel to the Z-axis of the reflector. The reflectors in the second configuration are offset in opposite Y directions from the center line by a distance $HS_1$ and $HS_2$ respectively. The radiators are spaced apart by a stagger distance (SD) defined by the following relationship:

$$SD=\sqrt{HS^2+VS^2}$$

where $$HS=HS_1+HS_2.$$

The antenna may further comprise a multipurpose port coupled to the one or more actuators to provide beam width control signals to the antenna. The antenna may further comprise a signal dividing-combining network for providing RF signals to the plurality of radiators wherein the signal dividing-combining network includes a phase shifting network for controlling elevation beam tilt by controlling relative phase of the RF signals applied to the radiators.

In another aspect the present invention provides a mechanically variable beam width antenna comprising a generally planar reflector, a first plurality of radiators configured in a first column adjacent the reflector, a second plurality of radiators configured in a second column adjacent the reflector, a third plurality of radiators configured in a third column adjacent the reflector, and at least one actuator coupled to the first and second plurality of radiators. The first plurality of radiators and the second plurality of radiators are movable relative to each other in a direction generally parallel to the plane of the reflector from a first configuration wherein the first and second columns are spaced a first distance apart to a second configuration wherein the first and second columns are spaced a second distance apart.

In a preferred embodiment the antenna further comprises a multipurpose port coupled to the at least one actuator to provide beam width control signals to the antenna. The antenna may further comprise a signal dividing-combining network for providing RF signals to the plurality of radiators wherein the signal dividing-combining network includes a phase shifting network for controlling elevation beam tilt by controlling relative phase of the RF signals applied to the radiators. The first and second plurality of radiators are preferably configured in rows aligned perpendicularly to the columns and the third plurality of radiators are offset from the rows of the first and second plurality of radiators. More specifically, the columns comprising the first and second plurality of radiators are spaced apart a distance HS and the orthogonal offset between the first and second plurality of radiators and the third plurality of radiators is VS. A stagger distance (SD) between the first and second plurality of radiators and the third plurality of radiators is defined by the following relationship:

$$SD = \sqrt{\left(\frac{HS}{2}\right)^2 + VS^2}.$$

The antenna may further comprise a first plurality of radiator mount plates coupled to the first plurality of radiators and slidable relative to the reflector and a second plurality of radiator mount plates coupled to the second plurality of radiators and slidable relative to the reflector, wherein pairs of first and second mount plates are coupled to a common actuator.

In another aspect the present invention provides a method of adjusting signal beam width in a wireless antenna having a plurality of radiators, at least some of which are movable in a direction generally parallel to a plane of the reflector. The method comprises providing the radiators in a first configuration where the radiators are all aligned in a single column generally parallel to the reflector axis to provide a first signal beam width. The method further comprises adjusting at least some of the radiators in a direction generally orthogonal to the axis of the column to a second configuration wherein the radiators are configured in at least three separate columns of plural radiators to provide a second signal beam width.

In a preferred embodiment the method further comprises providing at least one beam width control signal for remotely controlling the position setting of the radiators. In the first configuration all radiators are preferably aligned with a center line of the reflector and in the second configuration alternate radiators are offset from the center line of the reflector in opposite directions. The method may further comprise providing variable beam tilt by controlling the phase of the RF signals applied to the radiators through a remotely controllable phase shifting network.

In another aspect the present invention provides a method of adjusting signal beam width in a wireless antenna having a plurality of radiators at least some of which are movable in a direction generally parallel to a plane of the reflector. The method comprises providing the radiators in a first configuration wherein the radiators are aligned in at least three separate columns of plural radiators to provide a first signal beam width. The method further comprises adjusting at least some of the radiators in a direction generally orthogonal to the axis of the columns to a second configuration, wherein the radiators are configured in at least three separate columns of plural radiators and wherein at least two of the columns have a different spacing between the axes of the columns than in the first configuration, to provide a second signal beam width.

In a preferred embodiment of the method the at least three separate columns of plural radiators comprise first and second columns configured with rows of radiators aligned generally orthogonal to the axis of the columns. The at least three separate columns of plural radiators further comprise a third column of radiators with radiators offset in a direction orthogonal to the rows of radiators comprising the first and second columns. The radiators comprising the first and second columns are movable relative to each other in the direction of the rows.

Further features and aspects of the invention are set out in the following detailed description of the invention.

DETAILED DESCRIPTION OF THE INVENTION

Reference will be made to the accompanying drawings, which assist in illustrating the various pertinent features of the present invention. The present invention will now be described primarily in solving aforementioned problems relating to use of plurality of mechanical phase shifters, it should be expressly understood that the present invention may be applicable in other applications wherein azimuth beam width control is required or desired.

First Embodiment

Figure 1A:
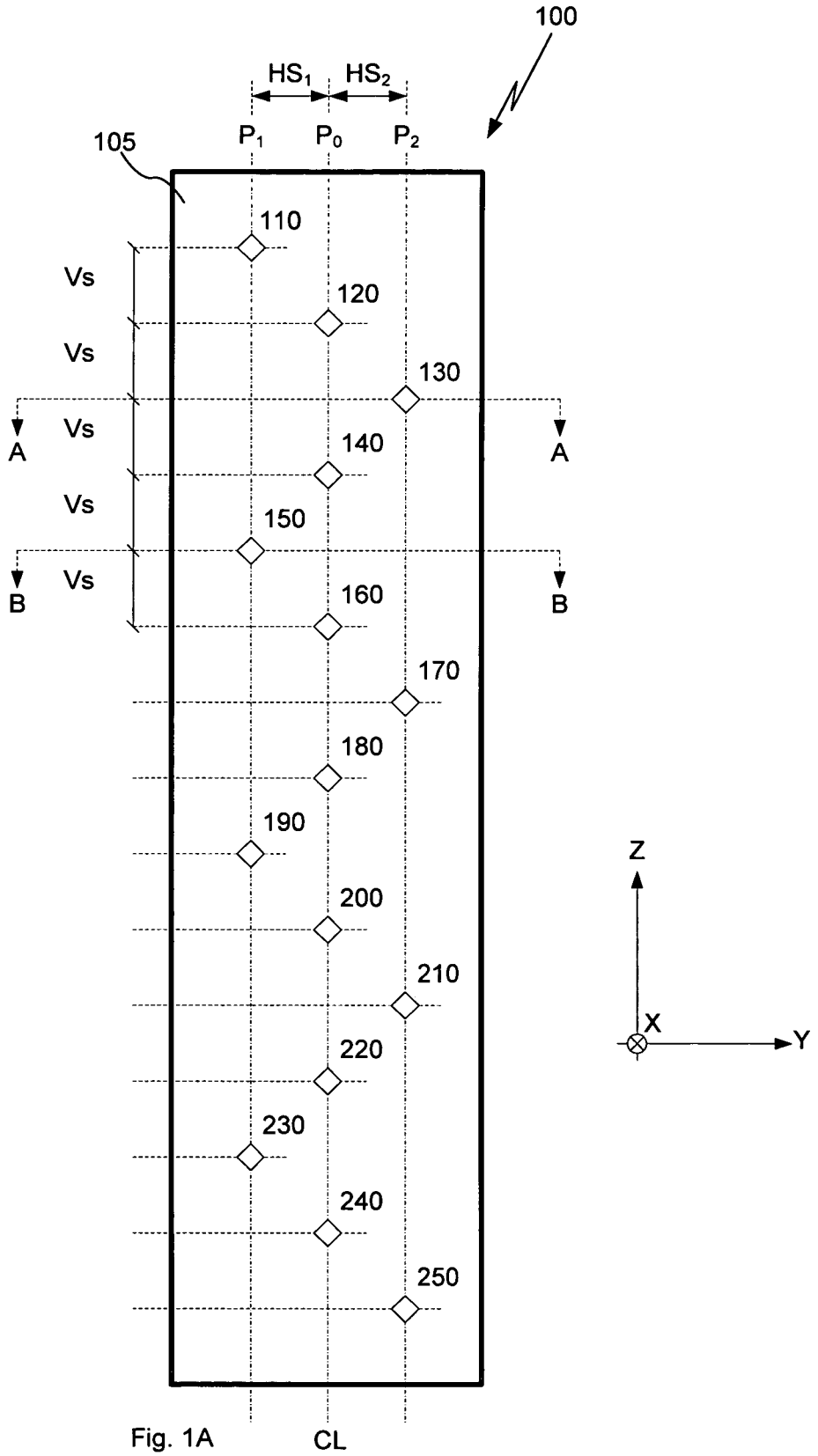
FIG. 1A is a front view of a dual polarization, triple column antenna array in narrow azimuth beam width setting in accordance with a first embodiment of the invention.

FIG. 1A shows a front view of a dual polarization, triple column antenna array, 100, according to a first exemplary implementation of the invention. The array utilizes a conventionally disposed reflector 105. Reflector, 105 is oriented in a vertical orientation (Z-dimension) of the antenna array. The reflector, 105, may, for example, consist of an electrically conductive plate suitable for use with Radio Frequency (RF) signals. Further, reflector 105, plane is shown as a featureless rectangle, but in actual practice additional features (not shown) may be added to aid reflector performance.

Continuing with reference to FIG. 1A an antenna array, 100, contains a plurality of RF radiating (110, 120, 130, 140-to-250) elements preferably arranged both vertically and horizontally in a triple column arrangement along three operationally defined vertical axis. The left most axis, P1, provides horizontal alignment movement limit to shiftable plates 154, (114, 194, 234 are not shown) operationally disposed below the forward facing surface of the reflector 105 in the corresponding reflector orifices 153, (113, 193, 233 are not shown). The right most axis, P2, provides horizontal alignment movement limit to shiftable plates 134, (174, 214, 254 not shown) operationally disposed below the forward facing surface of the reflector 105 in the corresponding reflector orifices 133, (173, 213, 253 not shown). Centrally disposed axis, P0, is co-aligned with vertical center line CL of the reflector 105. In this particular embodiment RF radiating elements (120, 140, 160, 180, 200, 220, 240) are vertically aligned about P0 axis and are not equipped with horizontal movement capability. It is possible to implement the antenna array wherein centrally disposed radiating elements (120, 140, 160, 180, 200, 220, 240) can be horizontally moveable thus allowing enhanced beam width shape control.

Figure 3A:
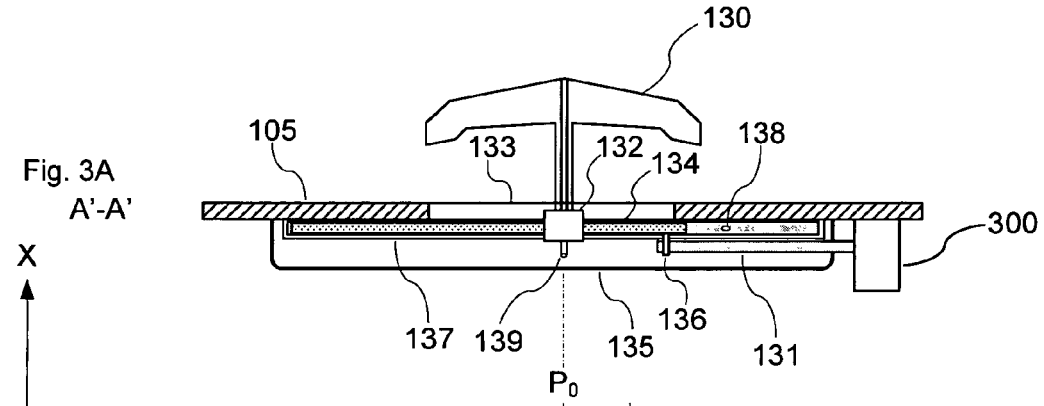
FIG. 3A and FIG. 3B provide cross sectional view details along A-A datum detailing the motion of a dual polarized antenna element corresponding to a wide (FIG. 2A) and narrow (FIG. 1A) azimuth beam width setting, respectively.
Figure 3B:
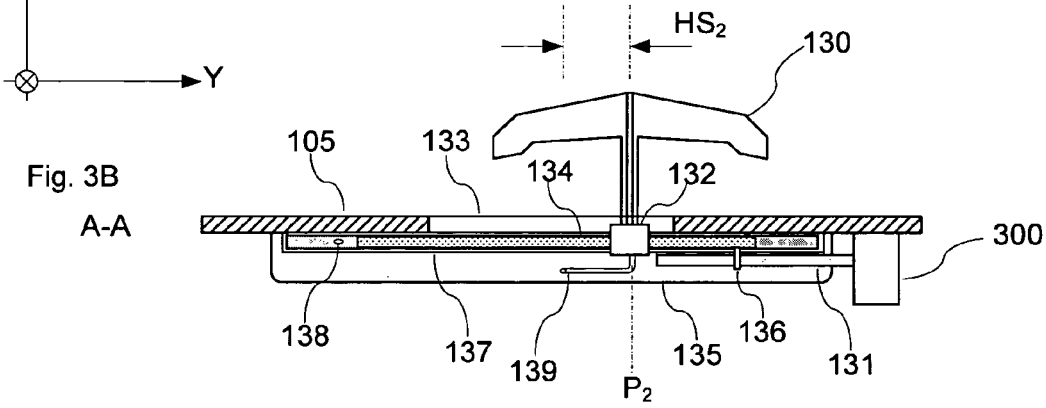
Figure 3C:
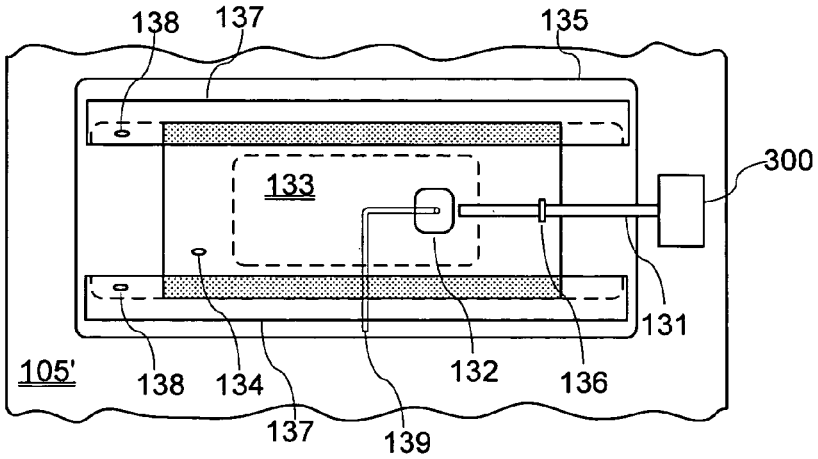
FIG. 3C is a back side view of the area immediate about the third radiating element with movable plate positioned as depicted in FIG. 3B.

Referring to FIGS. 3A-3C, right most RF radiating 130 element (or RF radiator for short) is mounted on corresponding feed-through mount 132 centrally disposed on a top surface of a shiftable foundation mount plate 134 capable of controllable orthogonal (horizontal) movement relative to the main vertical axis P0 limited by the peripheral dimensions of the corresponding reflector orifices 133. The maximum right most displacement of the radiating element 130 is defined by limit axis P2 and traversal distance HS2. In addition to radiator 130, radiators 170, 210, and 250 are similarly equipped and are mounted on corresponding feed-through mounts (not shown 172, 212, 252) centrally disposed on a top surface of a shiftable foundation mount plate (not shown 174, 214, 254, 234) exhibiting identical controllable orthogonal movement relative to the main vertical axis limited by the peripheral dimensions of the corresponding reflector orifices (not shown 173, 213, 253). Details pertaining to movable foundation mount plate 114 and relating structures will become apparent upon examination of FIGS. 3A, B and C.

Figure 4A:
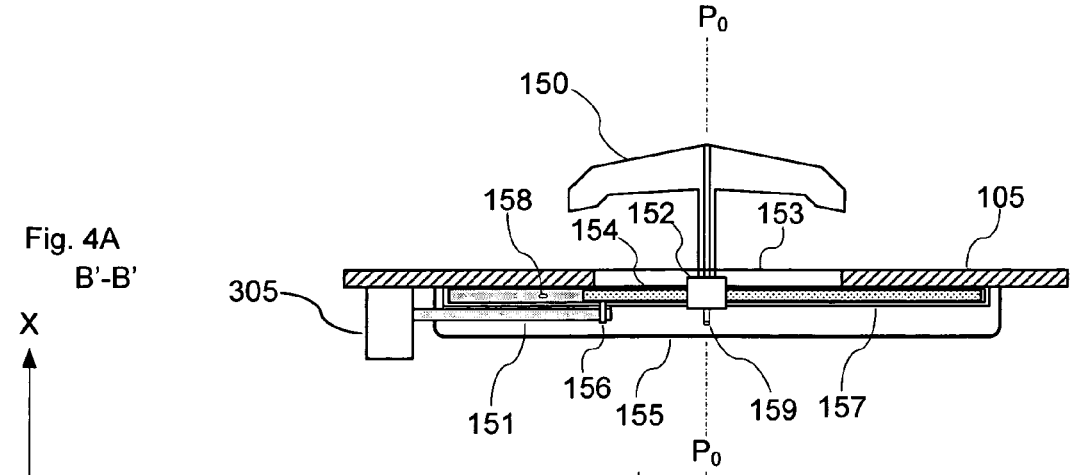
FIG. 4A and FIG. 4B provide cross sectional view details along B-B datum detailing the motion of a dual polarized antenna element corresponding to a wide (FIG. 2A) and narrow (FIG. 1A) azimuth beam width setting, respectively.
Figure 4B:
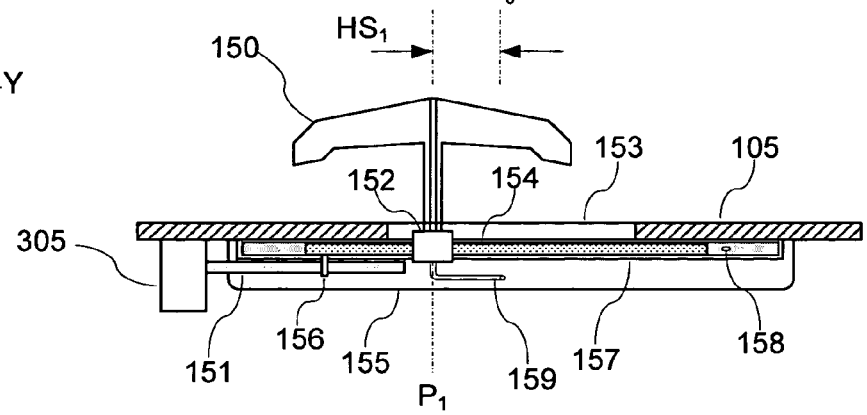
Figure 4C:
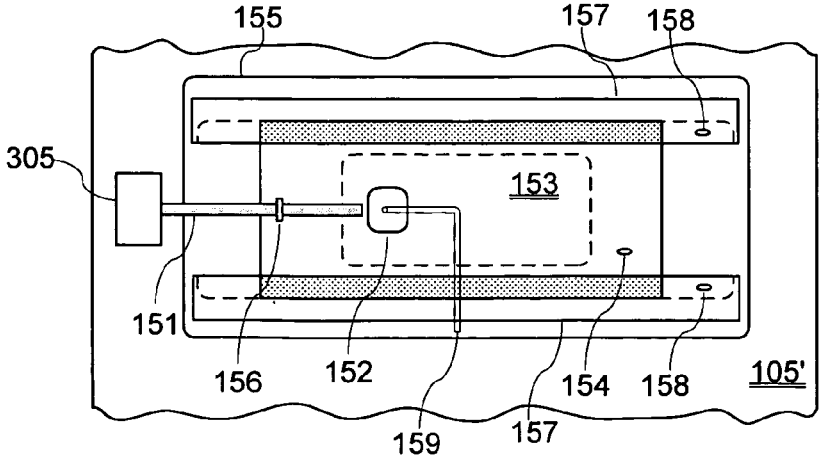
FIG. 4C is a back side view of the area immediate about the fifth radiating element with movable plate positioned as depicted in FIG. 4B.

Referring to FIGS. 4A-4C, left most RF radiator 150 is similarly mounted on corresponding feed-through mount 152 centrally disposed on a top surface of a shiftable foundation mount plate 154 capable of controllable orthogonal movement relative to the main vertical axis limited by the peripheral dimensions of the corresponding reflector orifices 153. The maximum left most displacement of the radiating element 150 is defined by limit axis P1 and traversal distance HS1. In addition to radiator 150 radiators 110, 190, and 230 are similarly equipped and are mounted on corresponding feed-through mounts (not shown 112, 192, 232) centrally disposed on a top surface of a shiftable foundation mount plate (not shown 114, 194, 234) exhibiting identical controllable orthogonal movement relative to the main vertical axis limited by the peripheral dimensions of the corresponding reflector orifices (not shown 113, 293, 233). Details pertaining to movable foundation mount plate 154 and relating structures will become apparent upon examination of FIGS. 4A, B and C.

Figure 2A:
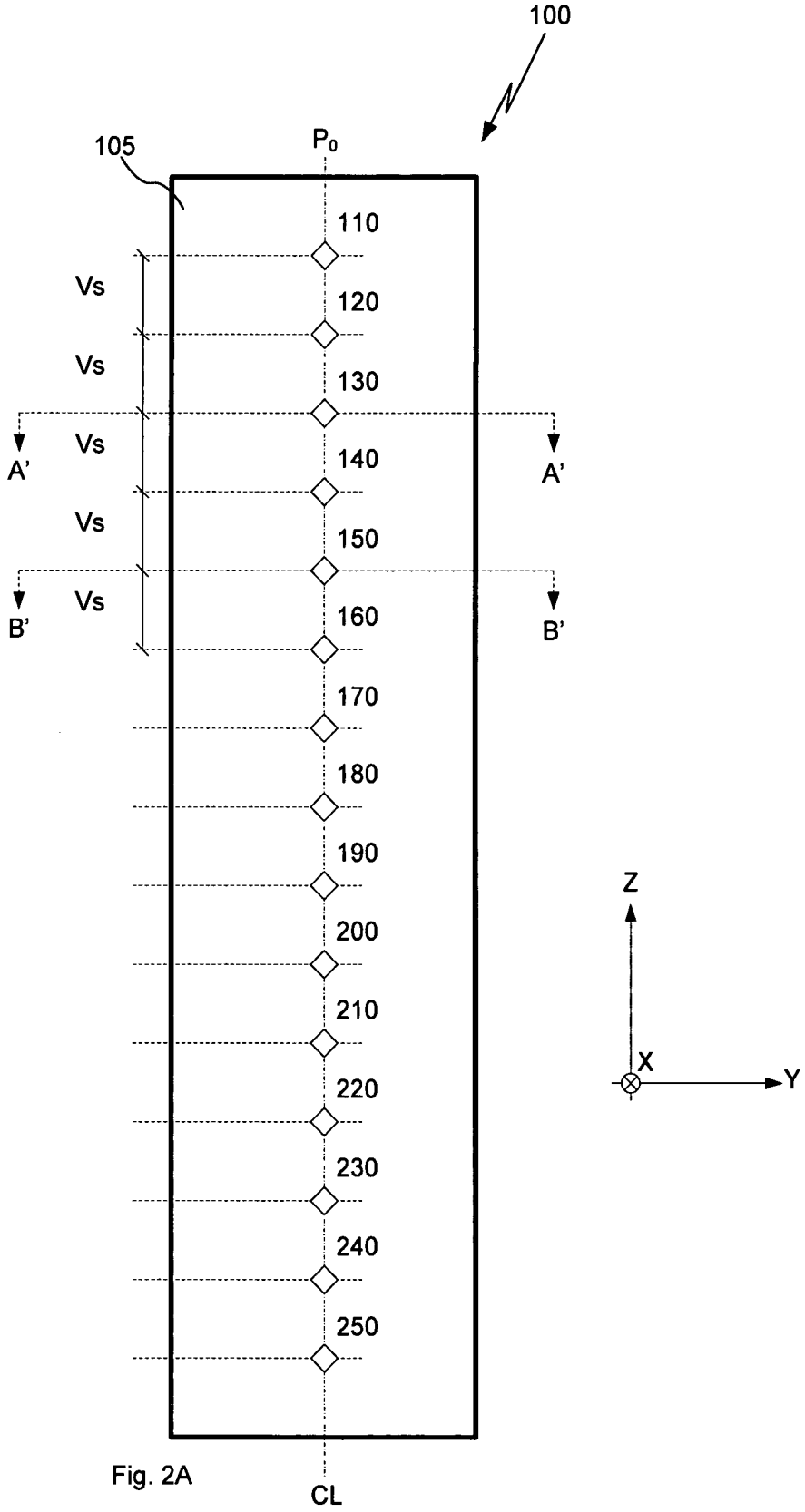
FIG. 2A is a front view of a dual polarization, triple column antenna array in wide azimuth beam width setting in accordance with a first embodiment of the invention.

In an antenna system 100 configured for a broad beam width radiation pattern, the RF radiators are preferably aligned along the common vertical axis labeled $P_0$ and are separated vertically by a distance VS. Preferably, the common axis $P_0$ is the same as center vertical axis of the reflector 105, plane. Such a broad beam width configuration is illustrated in FIG. 2A. Alignment axis $P_0$ is equidistant from the vertical edges of the of the reflector 105, plane. For this nominal configuration stagger distance (SD) is defined by the following relationship:

$$SD=VS$$

For a narrow beam width azimuth radiation pattern left group RF radiators (110, 150, 190, and 230) are positioned at leftmost alignment position and right group (130, 170, 210, and 250) are positioned as shown in FIG. 1A. This position is characterized by stagger distance (SD) which for a particular setting can be defined by the following relationship:

$$SD=\sqrt{HS^2+VS^2} \text{ where } HS=HS_1=HS_2$$

Through computer simulations and direct EM field measurement it was determined that the azimuth radiation beam pattern can be deduced from the above formula. By varying HS dimension desired azimuth beam width settings can be attained. VS dimension is defined by the overall length of the reflector 105 plane which defines the effective antenna aperture. In the illustrative non-limiting implementation shown, RF radiator, 105, together with a plurality of folded dipole (110, 120, 130, 140-to-250) radiating elements form an antenna array useful for RF signal transmission and reception. However, it shall be understood that alternative radiating elements, such as taper slot, horn, aperture coupled patches (APC), and etc, can be used as well.

A cross section datum A-A and B-B will be used to detail constructional and operational aspects relating to radiating elements relative movement. Drawing details of A-A datum can be found in FIG. 3A and FIG. 3B.

FIGS. 3A and 3B provide cross sectional views along A-A datum. A-A datum, as shown in FIG. 1A, bisects right side movable radiating element 130 and associated mechanical structures. FIG. 3C provides a back side view of the area immediate of the third radiating element 130. It shall be understood that all right side movable radiating elements share similar construction features, details being omitted for clarity. As shown in FIG. 3A a vertically polarized radiating element 130 is mounted with a feed-through mount 132. A feed through mount 132 is preferably constructed out of a dielectric material and provides isolation means between radiating element 130 and movable plate 134. Movable plate 134 is preferably constructed utilizing a rigid material as long as the plate's top surface is comprised of highly conductive material, but alternatively can be constructed from aluminum plate and the like. The RF signal is individually supplied from a power dividing-combining network 310 with a suitable flexible radio wave guide 139, such as flexible coaxial cable, and coupled to conventionally constructed feed through mount terminals 132 (details are not shown).

Movable foundation mount plate 134 is recessed, and mounted immediately below the bottom surface of radiator 105 plane and supported with a pair of sliding 137 guide frames, on each side reflector orifice 133, having u-shape slots 138 which provide X (vertical) dimensional stability while providing Y (horizontal when viewed from front of the antenna) dimensional movement for the movable foundation mount plate 134. As shown in FIG. 3C the back side of the movable foundation mount plate 134 and associated sliding guide frames 137 which are used for support are enclosed with a suitably constructed cover 135 to prevent undesirable back side radiation and to improve the front to back signal ratio. Actuator 300 provides mechanical motion means to the jack screw 131. Jack screw rotation is coupled to a mechanical coupler 136 attached to the back side movable foundation mount plate 134. By controlling direction and duration of rotation of the jack screw 131 subsequently provides Y dimensional movement to the movable foundation mount plate 134. As will be appreciated by those skilled in the art jack screw 131 is one of many possible means to achieve Y-dimensional movement to the movable foundation mount plate 134. The mechanical actuator 300, or other well known means, may be extended to provide mechanical motion means to other or preferably all other right side jack screws 131, 171, 211, and 251 used to control motion of respective radiating elements 130, 170, 210, and 250.

The above description outlines basic concepts covering right side radiating element group (130, 170, 210 & 250), but it shall be understood that basic building elements are replicated for left hand side radiating element group (110, 150, 190, 230) as well, while incorporating appropriate directional changes to accommodate element movement relative to the centerline $P_0$. In some instances it maybe advantageous to combine or perhaps mirror mount mechanical assemblies into a single device as deemed appropriate for the application.

It is also possible to provide an antenna element position configuration such that $HS_1 \neq HS_2$. Such configuration is possible since right side jack screw 300 and left side jack screw 305 are independently controlled. Resultant antenna array azimuth pattern may exhibit a desirable pattern skew which can be altered based on operational requirements.

Figure 5:
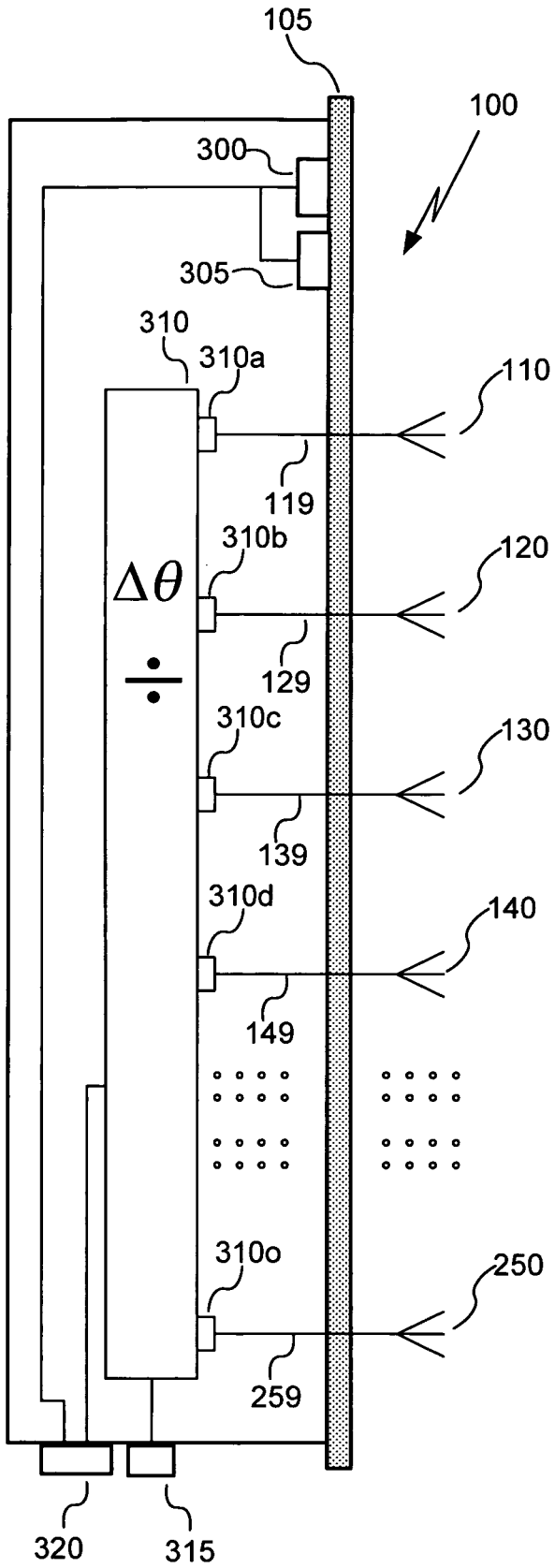
FIG. 5 is an RF circuit diagram of an antenna array equipped with a Phase Shifter and Power Divider.

With reference to FIG. 5 RF radiator elements (110, 120, 130, 140, -to-250) are fed from a master RF input port, 315, with the same relative phase angle RF signal through a conventionally designed RF power signal dividing-combining network 310. RF power signal dividing-combining network 310 output-input ports 310(*a-o*) are coupled via suitable radio wave guides (119, 129, 139, 149-to-259), such as coaxial cable to corresponding radiating elements (110, 120, 130, 140-to-250). In some operational instances such RF power signal 310 dividing-combining network may include a remotely controllable phase shifting network so as to provide beam tilting capability as described in U.S. Pat. No. 5,949,303 assigned to current assignee and incorporated herein by reference. An example of such an implementation is shown in FIG. 5 wherein RF signal dividing-combining network 310 provides an electrically controlled beam down-tilt capability. Phase shifting function of the power dividing network 310 may be remotely controlled via multipurpose control port 320. Similarly, azimuth beam width control signals are coupled via multipurpose control port 320 to left 300 and right 305 side mechanical actuators. Since each side mechanical actuators are individually controlled it possible to set the amount of element displacement differently. This provides advantageous means for radiation pattern skewing and azimuth beam width control.

As was described hereinabove a plurality of radiating elements (110, 120, 130, 140, -to-250) together form an antenna array useful for RF signal transmission and reception.

Figure 7:
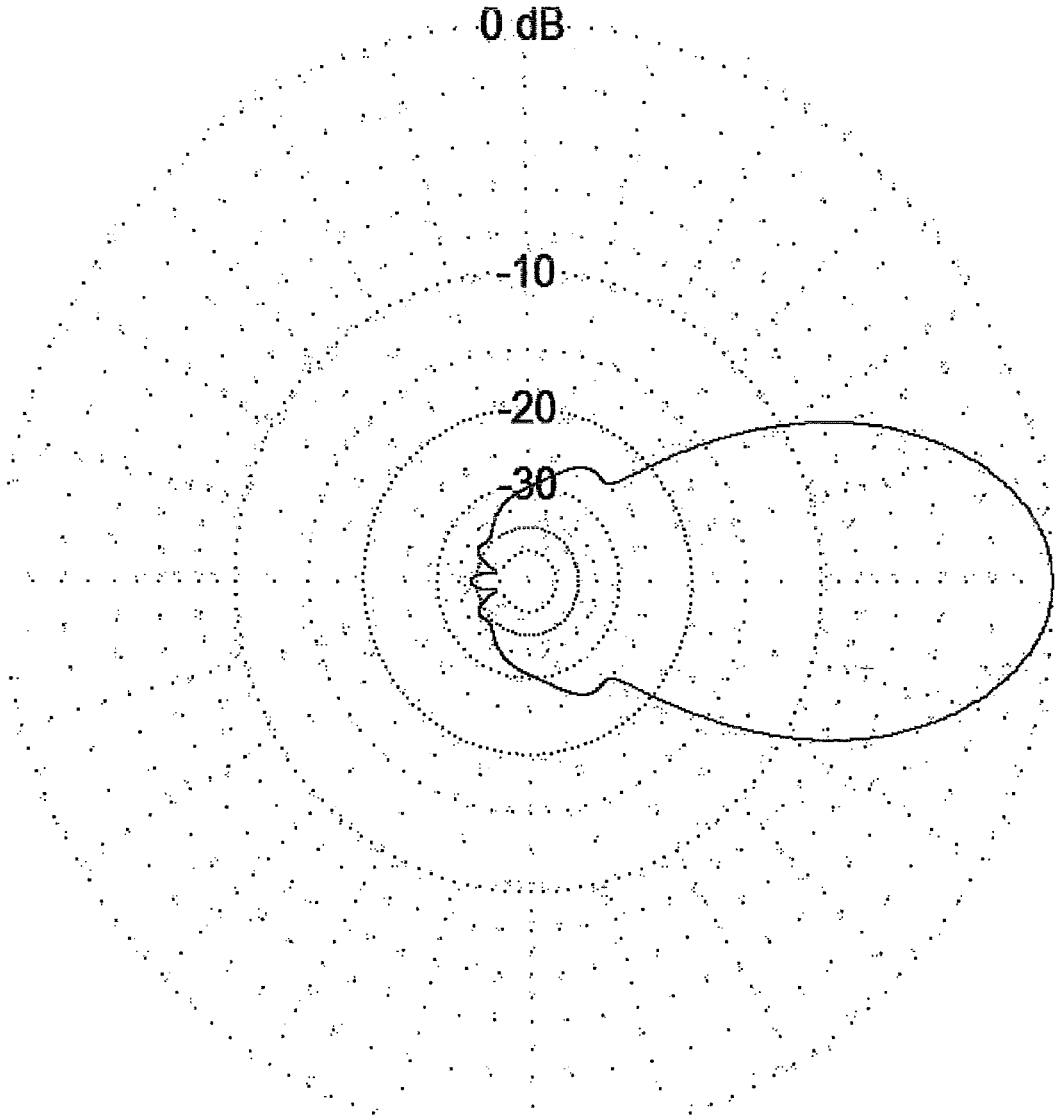
FIG. 7 is a simulated azimuth radiation pattern of an antenna (first embodiment) configured for narrow azimuth beam width (FIG. 1A).

Consider the following two operational conditions (a-b):

Operating condition (a) wherein all RF radiators (110, 120, 130, 140-to-250), as depicted in FIG. 2A, are aligned about $P_0$ axis which is proximate to vertical center axis of the reflector 105 plane. Such alignment setting will result in a relatively wide azimuth beam width as shown in the simulated pattern of FIG. 7.

Figure 8:
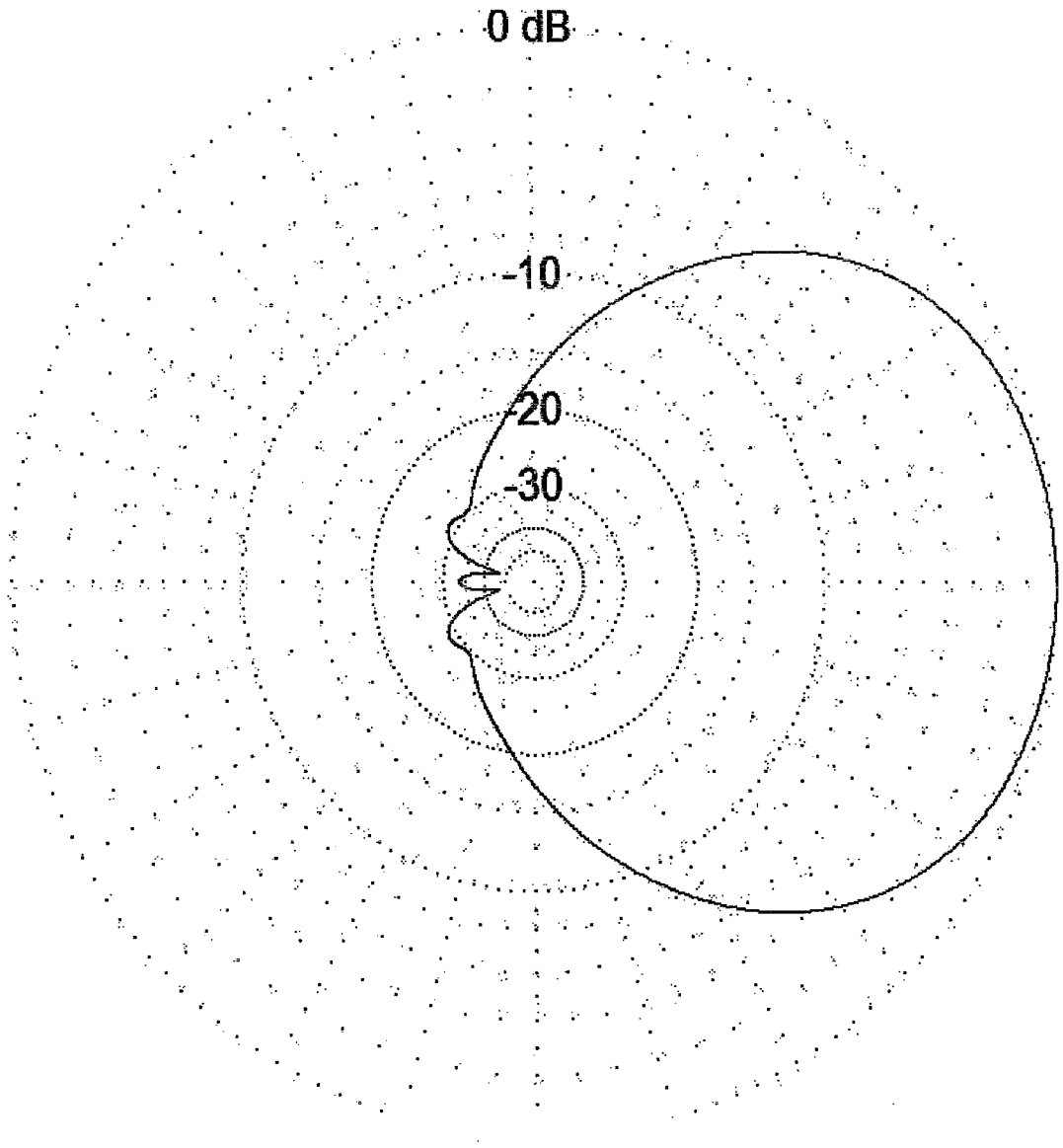
FIG. 8 is a simulated azimuth radiation pattern of an antenna (first embodiment) configured for wide azimuth beam width (FIG. 2A).

Operating condition (b) wherein RF radiators (110, 120, 130, 140) as depicted in FIG. 1A, are positioned in the following configuration: The left side group of RF radiators 110, 150, 190, and 230 are positioned along $P_1$ axis and right group of RF radiators 130, 170, 210, 250 are positioned along $P_2$ axis. The resultant azimuth radiation beam width will be narrower when compared to (a). Such alignment setting will result in a relatively wide azimuth beam width as shown in the simulated pattern of FIG. 8. Obviously, $HS_1$ and $HS_2$ can be varied continuously from a minimum (0) to a maximum value to provide continuously variable azimuth variable beam width between two extreme settings described hereinabove. It is possible to achieve azimuth HBW from 30 to 90 degrees while utilizing relatively small sized reflector width commonly used with non adjustable antennas. Narrower HBW azimuths can be achieved with wider size reflector 105 and increased HS1 and HS2 dimensions.

Second Embodiment

Figure 1B:
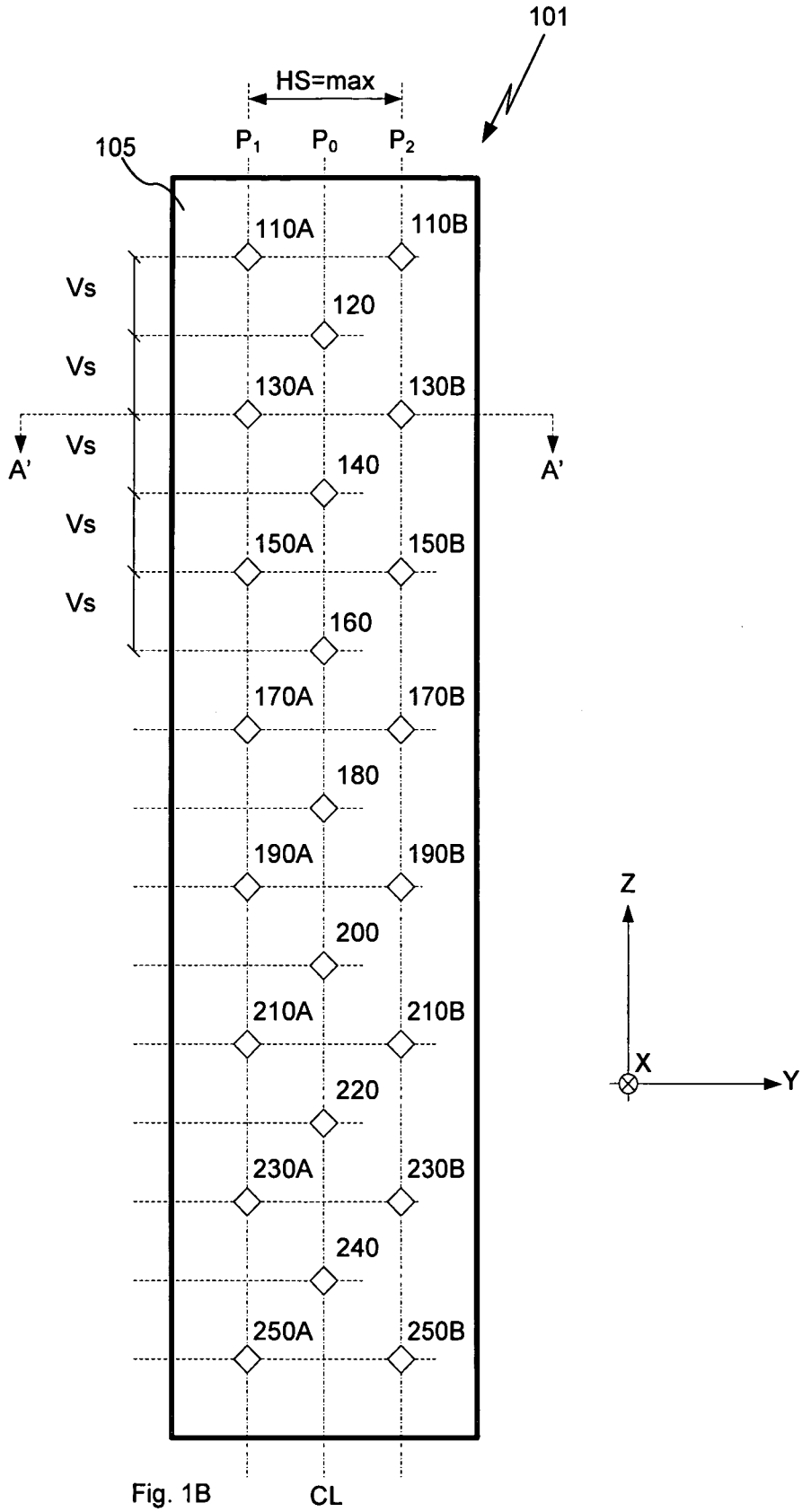
FIG. 1B is a front view of a dual polarization, triple column antenna array in narrow azimuth beam width setting in accordance with a second embodiment of the invention.

FIG. 1B shows a front view of a dual polarization, triple column antenna array, 101, according to an exemplary implementation of the invention in accordance with a second embodiment. The array utilizes a conventionally disposed reflector 105. Reflector, 105 is oriented in a vertical orientation (Z-dimension) of the antenna array. The reflector, 105, may, for example, comprise an electrically conductive plate suitable for use with RF signals. Further, reflector 105, plane is shown as a featureless rectangle, but in actual practice additional features (not shown) may be added to aid reflector performance.

Continuing with reference to FIG. 1B an antenna array, 101, contains a plurality of horizontally displaceable RF radiating element pairs (110A-110B, 130A-130B, -to-250A-250B) preferably arranged both vertically and horizontally, in a dual column arrangement along operationally defined vertical axis P1 and P2. In between horizontally moveable element pairs, fixed radiating elements 120, 140, 160, 180, 200, 220, 240 are placed along vertical centerline axis P0. Each horizontally displaceable RF radiating element pair (110A-110B, 130A-130B, -to-250A-250B) is provided with displacement means to provide equidistant motion for its individual radiating elements 110A and 110B.

Figure 6A:
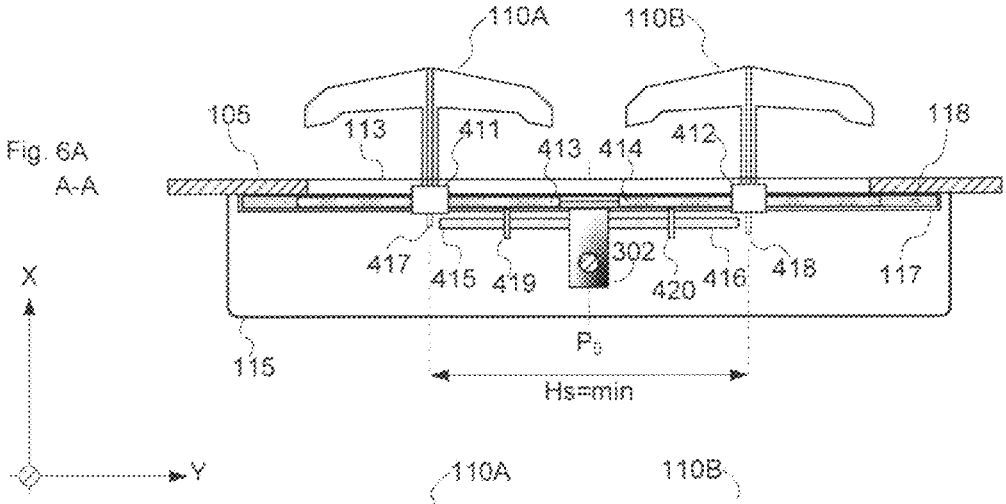
FIG. 6A and FIG. 6B provide cross sectional view details along C-C datum detailing the motion of a dual polarized (second embodiment) antenna element corresponding to a wide (FIG. 2B) and narrow (FIG. 1B) azimuth beam width setting, respectively.
Figure 6B:
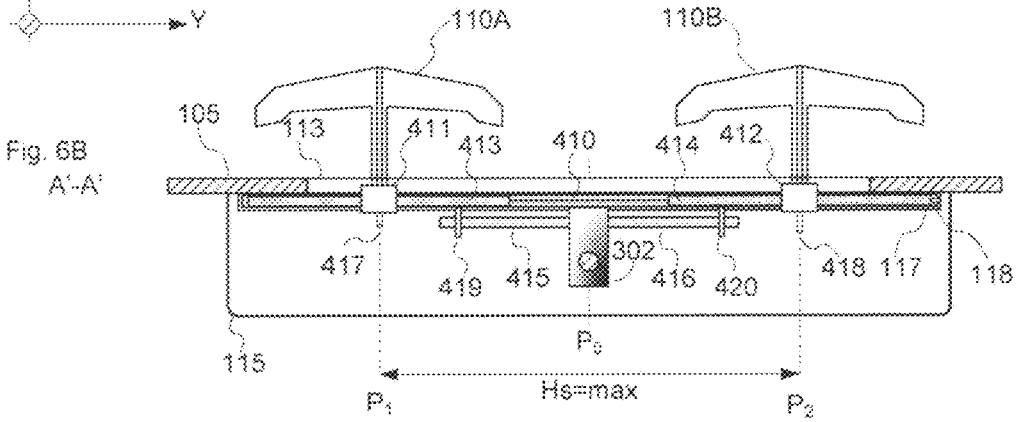

In reference to FIGS. 6A and 6B right mounted RF radiating element 110A is mounted with feed-through mount 411 on top of right moveable plate 413. Similarly, right mounted RF radiating element 110B is mounted with feed-through mount 412 on top of right moveable plate 414. Both left 413 and right 414 plates are operationally disposed below the forward facing surface of the reflector 105 in the reflector orifice 113. Electrically conductive filler panel 410 is used to bridge variable gap between the left 413 and right 414 moveable plates to prevent ground discontinuity as the two moveable plates are moved apart or toward each other horizontally and equidistantly about the center axis P0. A suitable mechanical actuator 302 is provided to provide equidistant horizontal displacement about antenna array center axis P0.

Figure 6C:
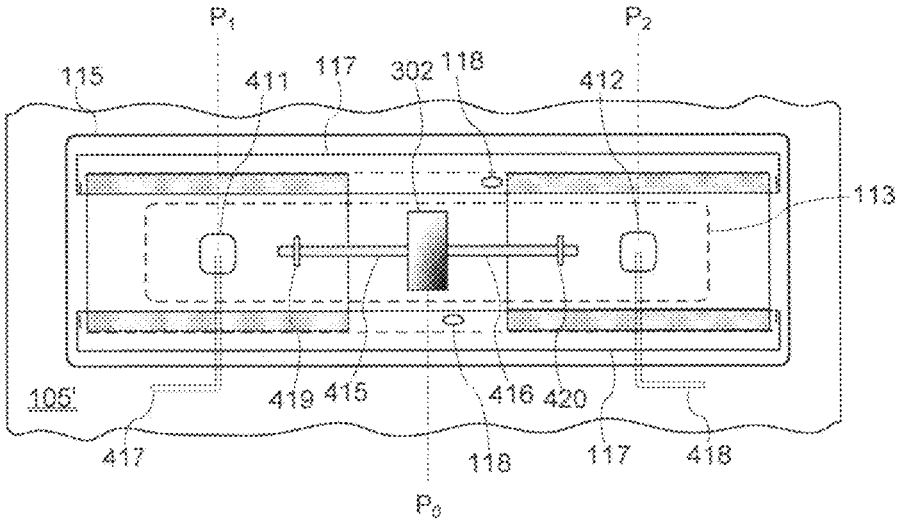
FIG. 6C is a back side view of the area immediate about a radiating element with movable plate positioned as depicted in FIG. 6B.

Movable foundation mount left 413 and right 414 plates are recessed, and mounted immediately below the bottom surface of radiator 105' plane and supported with a pair of sliding 117 guide frames, on top and bottom sides of reflector orifice 133, having u-shape slots 118 which provide X (vertical) dimensional stability while providing Y (horizontal when viewed from front of the antenna) dimensional movement for the movable foundation mount plates 413 and 414. In FIG. 6C the back side of the movable foundation plates and associated sliding guide frames 117 are covered with suitably constructed back cover 115 to prevent undesirable back side radiation and to improve the front to back signal ratio.

Mechanical actuator 302 is equipped with left 415 and right 416 jack screws to provide equidistant displacement about center axis to corresponding left 413 and right 414 moveable plates. Left 415 and right 416 jack screws are operationally coupled via left 419 and right 420 rotation to linear displacement couplers that are attached to corresponding left 413 and right 414 moveable plates. Altering jack screw rotation effectively changes the direction of travel for both RF radiating element 110A-B in unison such that both RF radiating elements 110A and 110B are equidistant about center axis P0. It should be readily apparent to those skilled in the art that the jack screw arrangement can be replaced with any alternative mechanical actuator suitably adapted for this purpose.

Net horizontal displacement of RF radiating elements 110A-B is measured between feed through (411, 412) centerlines min≤$H_s$≤max where, for antenna system design to operate between 1.7 to 2.1 GHz min=90 mm and max=190 mm. Movable RF radiating elements stagger distance (SD) for a particular setting can be defined by the following relationship:

$$SD = \sqrt{\left(\frac{HS}{2}\right)^2 + VS^2}$$

Through computer simulations and direct EM field measurement it was determined that the azimuth radiation beam pattern can be deduced from above formula.

RF radiating elements 110A-B are provided with corresponding RF feed lines 417 and 418. In downlink transmission mode the RF signal, from power combiner-divider network 310, is delivered from port 310*a* to a conventional in phase 3 dB divider (not shown) network having its first output port coupled left side feed line 417 and second output port coupled right side feed line 418. In uplink receiving mode RF signals from RF radiating elements 110A-B are delivered to corresponding −3 dB ports of a conventional in phase 3 dB divider (not shown) network having its common port coupled to port 310*a* of the power combiner-divider network 310. Alternatively, combiner-divider network 310 can be modified to provide required coupled ports with necessary networks.

Figure 2B:
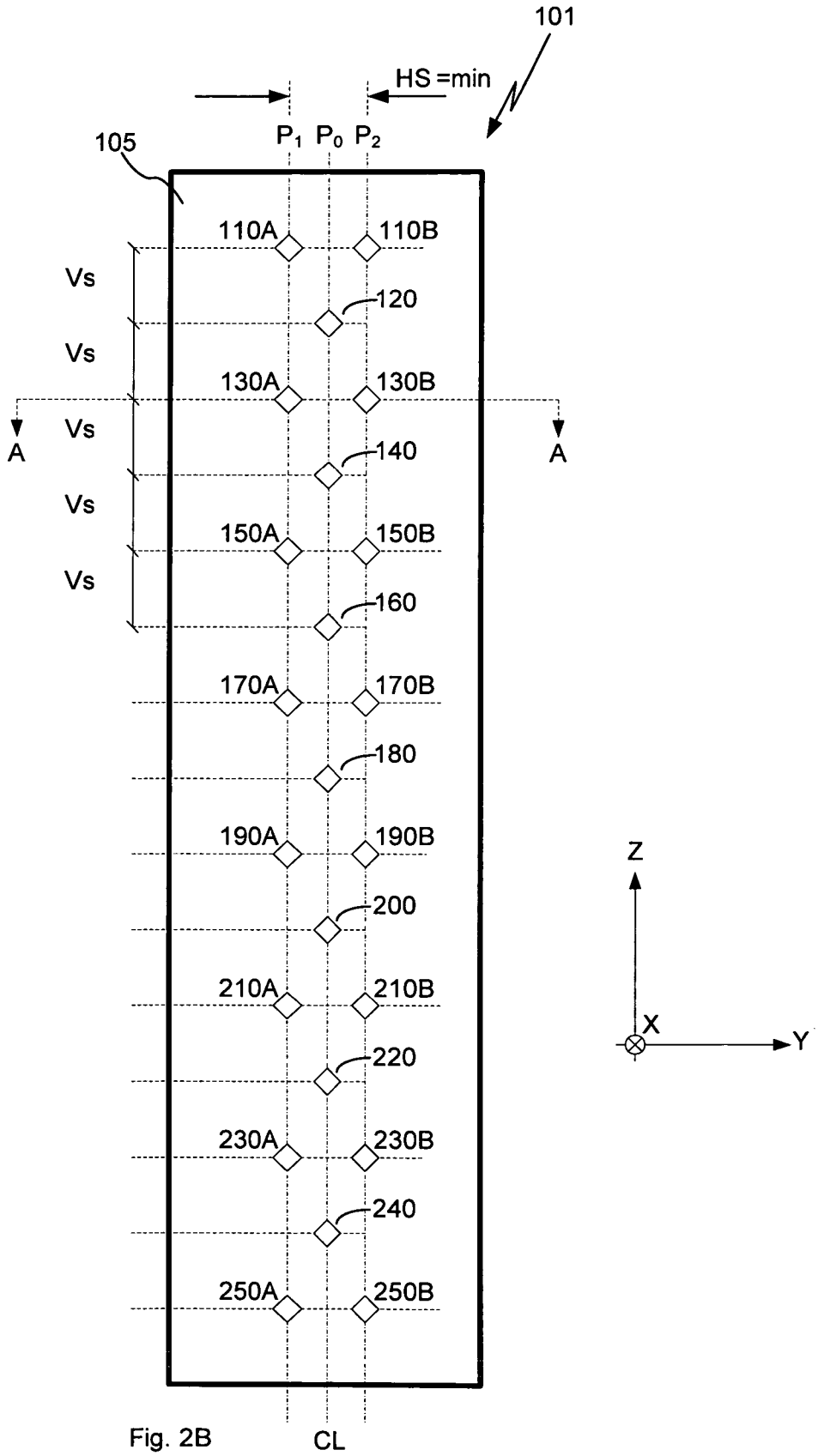
FIG. 2B is a front view of a dual polarization, triple column antenna array in wide azimuth beam width setting in accordance with a second embodiment of the invention.
Figure 9:
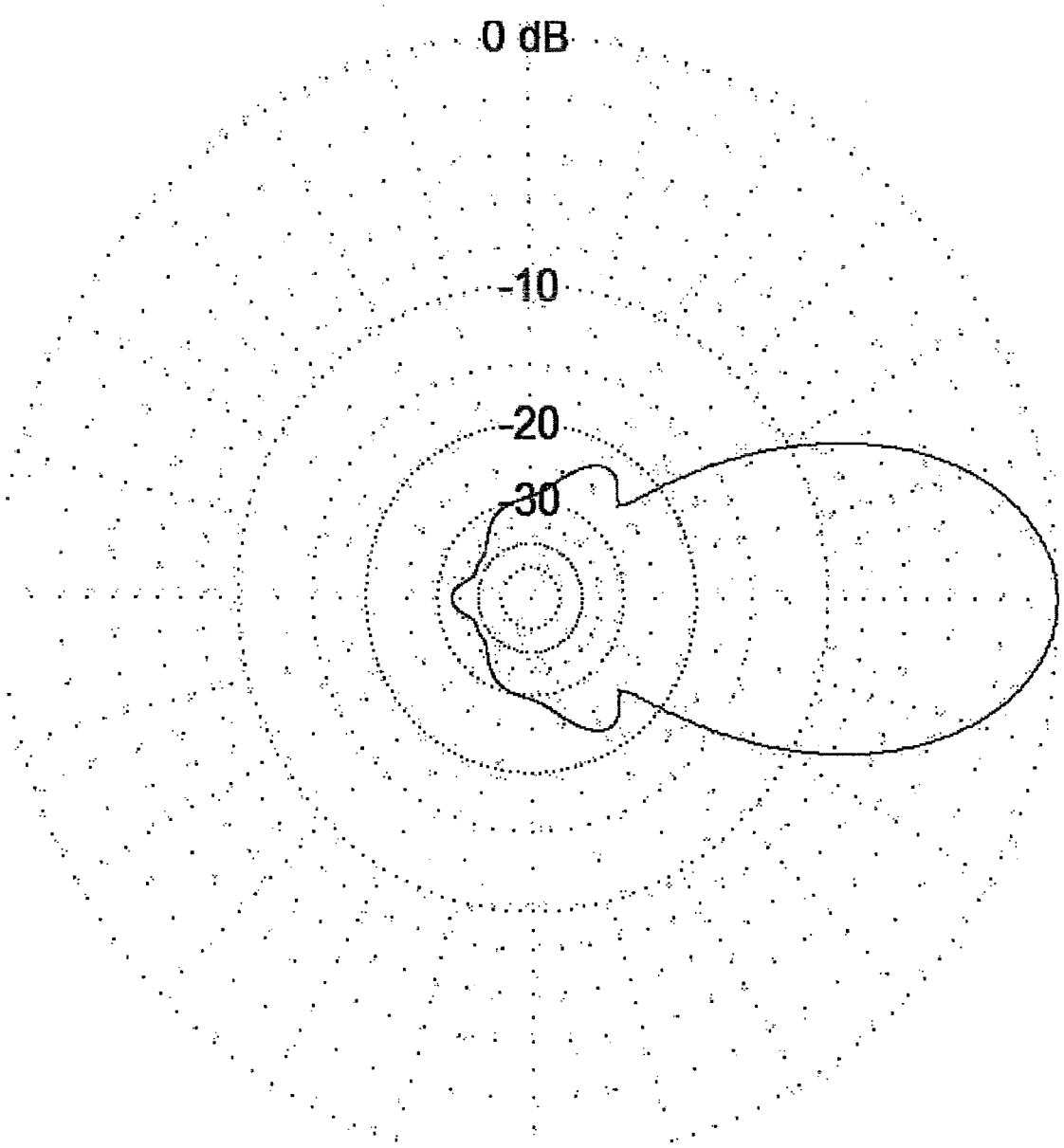
FIG. 9 is a simulated azimuth radiation pattern of an antenna (second embodiment) configured for narrow azimuth beam width (FIG. 1B).

Consider the following two operational conditions (c-d):

Operating condition (c) wherein all RF radiators (110A-B, 130A-B, -to-250A-B), as depicted in FIG. 2B, are aligned about corresponding $P_1$ and $P_2$ axis such that HS=minimum. Such an alignment setting will result in a relatively wide azimuth beam width as shown in the simulated pattern of FIG. 9.

Figure 10:
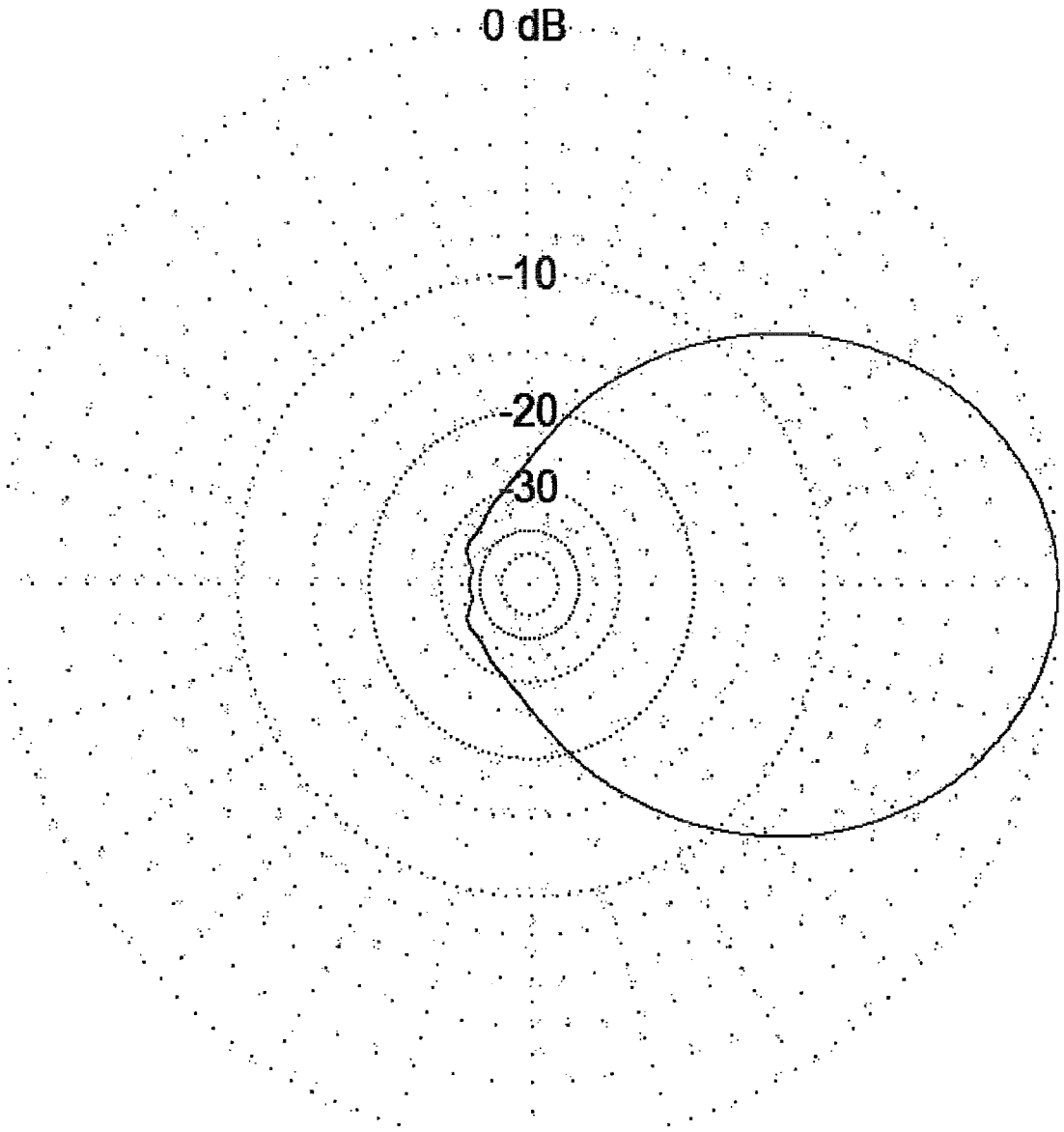
FIG. 10 is a simulated azimuth radiation pattern of an antenna (second embodiment) configured for wide azimuth beam width (FIG. 2B).

Operating condition (d) wherein all RF radiators (110A-B, 130A-B, -to-250A-B), as depicted in FIG. 1B, are aligned about corresponding $P_1$ and $P_2$ axis such that HS=maximum. Such an alignment setting will result in a relatively narrow azimuth beam width as shown in the simulated pattern of FIG. 10. The resultant azimuth radiation beam width will be narrower when compared to (c). Obviously, HS can be varied continuously from a minimum to a maximum value to provide continuously variable azimuth variable beam width between the two extreme settings described hereinabove. It is possible to achieve azimuth HBW from 30 to 90 degrees. As in the first embodiment it is possible to achieve azimuth HBW from 30 to 90 degrees while utilizing relatively small sized reflector width commonly used with non adjustable antennas. Further narrowing of the HBW azimuth angle can be achieved with wider size reflector 105 and increased HS dimension.

The foregoing description is presented for purposes of illustration and description. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A mechanically variable beam width antenna, comprising: a generally planar reflector; a first plurality of radiators configured in a first column adjacent the reflector; a second plurality of radiators configured in a second column adjacent the reflector; a third plurality of radiators configured in a third column adjacent the reflector; at least one actuator coupled to the first and second plurality of radiators, wherein the first plurality of radiators and the second plurality of radiators are movable relative to each other in a direction generally parallel to the plane of the reflector from a first configuration wherein the first and second columns are spaced a first distance apart to a second configuration wherein the first and second columns are spaced a second distance apart.

2. The antenna of claim 1, further comprising a multipurpose port coupled to the at least one actuator to provide beam width control signals to the antenna.

3. The antenna of claim 1, further comprising a signal dividing-combining network for providing RF signals to the plurality of radiators wherein the signal dividing-combining network includes a phase shifting network for controlling elevation beam tilt by controlling relative phase of the RF signals applied to the radiators.

4. The antenna of claim 1, wherein the first and second plurality of radiators are configured in rows aligned perpendicularly to said columns and the third plurality of radiators are offset from the rows of said first and second plurality of radiators.

5. The antenna of claim 3, wherein the columns comprising the first and second plurality of radiators are spaced apart a distance HS and the orthogonal offset between the first and second plurality of radiators and the third plurality of radiators is VS, and a stagger distance (SD) between the first and second plurality of radiators and the third plurality of radiators is defined by the following relationship:

$$SD = \sqrt{\left(\frac{HS}{2}\right)^2 + VS^2}.$$

6. The antenna of claim 1, further comprising a first plurality of radiator mount plates coupled to the first plurality of radiators and slidable relative to the reflector and a second plurality of radiator mount plates coupled to the second plurality of radiators and slidable relative to the reflector, wherein pairs of first and second mount plates are coupled to a common actuator.

* * * * *